US008146265B2

(12) United States Patent
Oh et al.

(10) Patent No.: US 8,146,265 B2
(45) Date of Patent: Apr. 3, 2012

(54) DISPLAY DEVICE OF DRYER

(75) Inventors: Chang Hun Oh, Changwon-si (KR); Seon Il Heo, Changwon-si (KR); Yang Hwan Kim, Changwon-si (KR); Yeong Sik Choi, Changwon-si (KR); Seog Ho Ko, Changwon-si (KR); Ju Han Yoon, Changwon-si (KR)

(73) Assignee: LG Electronics Inc., Seoul (KR)

( * ) Notice: Subject to any disclaimer, the term of this patent is extended or adjusted under 35 U.S.C. 154(b) by 980 days.

(21) Appl. No.: 12/104,744

(22) Filed: Apr. 17, 2008

(65) Prior Publication Data

US 2009/0145001 A1 Jun. 11, 2009

(30) Foreign Application Priority Data

Apr. 18, 2007 (KR) ..... 10-2007-0038074
Apr. 18, 2007 (KR) ..... 10-2007-0038076

(51) Int. Cl.
*F26B 11/02* (2006.01)

(52) U.S. Cl. ..... 34/282; 34/413; 34/601; 219/647; 96/421; 96/424; 68/5 R

(58) Field of Classification Search ..... 34/282, 34/88, 89, 413, 381, 601, 606, 610; 68/5 R; 219/647; 96/421, 424
See application file for complete search history.

(56) References Cited

U.S. PATENT DOCUMENTS 2,143,188 A * 1/1939 Coulter ..... 62/62
3,765,612 A * 10/1973 Wenger ..... 241/23
4,115,927 A * 9/1978 Rosensweig ..... 34/249
4,136,016 A * 1/1979 Rosensweig ..... 208/134
4,296,080 A * 10/1981 Rosensweig ..... 423/244.06
4,395,830 A * 8/1983 Lockwood ..... 34/365
RE31,439 E * 11/1983 Rosensweig ..... 34/249
5,097,606 A * 3/1992 Harmelink et al. ..... 34/467
5,291,667 A * 3/1994 Joslin et al. ..... 34/526
5,444,924 A * 8/1995 Joslin et al. ..... 34/486
5,554,416 A * 9/1996 Scheufler et al. ..... 427/378
5,673,496 A * 10/1997 Wegner et al. ..... 34/471
5,709,038 A * 1/1998 Scheufler et al. ..... 34/475
5,718,061 A * 2/1998 Scheufler et al. ..... 34/475
5,970,625 A * 10/1999 Scheufler et al. ..... 34/477

(Continued)

FOREIGN PATENT DOCUMENTS

DE 10 2006 047 720 4/2008

(Continued)

OTHER PUBLICATIONS

German Office Action dated Jun. 8, 2010.

(Continued)

*Primary Examiner* — Stephen M. Gravini
(74) *Attorney, Agent, or Firm* — KED & Associates, LLP

(57) ABSTRACT

A display device of a dryer, which can achieve the reliability of a function to display a clogging degree in the dryer, is disclosed. The display device includes a display unit for displaying a clogging degree of an air passage through at least one level indicator, and a controller for controlling the display unit when power is supplied, such that the level indicator flickers for a predetermined time, and then displays the clogging degree of the air passage. The display for the clogging degree of the air passage is executed, following the display of a normal operation state of the display unit.

13 Claims, 11 Drawing Sheets

U.S. PATENT DOCUMENTS

| | | | | |
|---|---|---|---|---|
| 6,035,551 | A * | 3/2000 | Scheufler et al. | 34/475 |
| 6,154,978 | A * | 12/2000 | Slutsky | 34/321 |
| 6,158,148 | A * | 12/2000 | Krausch | 34/497 |
| 6,203,859 | B1 * | 3/2001 | Scheufler et al. | 427/475 |
| 6,334,267 | B1 * | 1/2002 | Slutsky | 34/606 |
| 6,532,684 | B1 * | 3/2003 | Tunney et al. | 34/410 |
| 6,671,977 | B2 * | 1/2004 | Beaumont | 34/79 |
| 6,931,756 | B2 * | 8/2005 | Morgan et al. | 34/202 |
| 7,024,795 | B2 * | 4/2006 | Tadano et al. | 34/76 |
| 7,146,749 | B2 * | 12/2006 | Barron et al. | 34/596 |
| 7,415,781 | B2 * | 8/2008 | Barron et al. | 34/595 |
| 7,591,881 | B2 * | 9/2009 | Yeager et al. | 95/117 |
| 7,785,398 | B2 * | 8/2010 | Dewald et al. | 95/106 |
| 7,805,856 | B2 * | 10/2010 | Ga.beta.mann et al. | 34/85 |
| 7,882,647 | B2 * | 2/2011 | Ikemizu | 34/524 |
| 7,891,113 | B2 * | 2/2011 | Oh et al. | 34/282 |
| 7,947,929 | B2 * | 5/2011 | Oh et al. | 219/482 |
| 7,957,842 | B2 * | 6/2011 | Boder et al. | 700/283 |
| 2001/0005525 | A1 * | 6/2001 | Scheufler et al. | 427/195 |
| 2002/0023368 | A1 * | 2/2002 | Beaumont | 34/79 |
| 2003/0097763 | A1 * | 5/2003 | Morgan et al. | 34/468 |
| 2004/0143994 | A1 * | 7/2004 | Baron et al. | 34/597 |
| 2004/0187343 | A1 * | 9/2004 | Beaumont | 34/544 |
| 2004/0237331 | A1 * | 12/2004 | Sarfaty et al. | 34/218 |
| 2005/0044744 | A1 * | 3/2005 | Tadano et al. | 34/596 |
| 2005/0160620 | A1 * | 7/2005 | Morgan et al. | 34/469 |
| 2006/0112588 | A1 * | 6/2006 | Ness et al. | 34/513 |
| 2006/0218812 | A1 * | 10/2006 | Brown | 34/86 |
| 2007/0079589 | A1 * | 4/2007 | Ekstrom et al. | 55/385.1 |
| 2007/0094888 | A1 * | 5/2007 | Barron et al. | 34/597 |
| 2007/0101603 | A1 * | 5/2007 | Beaumont | 34/85 |
| 2007/0107250 | A1 * | 5/2007 | Gassmann et al. | 34/82 |
| 2007/0175063 | A1 * | 8/2007 | Morgan et al. | 34/467 |
| 2007/0245591 | A1 * | 10/2007 | Gens et al. | 34/443 |
| 2008/0098615 | A1 * | 5/2008 | Kim | 34/493 |
| 2008/0177994 | A1 * | 7/2008 | Mayer | 713/2 |
| 2008/0276484 | A1 * | 11/2008 | Dewald et al. | 34/473 |
| 2008/0282568 | A1 * | 11/2008 | Oh et al. | 34/72 |
| 2008/0307667 | A1 * | 12/2008 | Ikemizu | 34/132 |
| 2008/0313921 | A1 * | 12/2008 | Oh et al. | 34/491 |
| 2008/0313923 | A1 * | 12/2008 | Oh et al. | 34/524 |
| 2009/0139108 | A1 * | 6/2009 | Ricklefs et al. | 34/130 |
| 2009/0139110 | A1 * | 6/2009 | Oh et al. | 34/553 |
| 2009/0145001 | A1 * | 6/2009 | Oh et al. | 34/282 |
| 2009/0255142 | A1 * | 10/2009 | Brown | 34/79 |
| 2009/0272003 | A1 * | 11/2009 | Dalton et al. | 34/329 |
| 2010/0299952 | A1 * | 12/2010 | Hollinger et al. | 34/201 |
| 2010/0299954 | A1 * | 12/2010 | Roselle et al. | 34/390 |
| 2011/0099834 | A1 * | 5/2011 | Brown | 34/132 |

FOREIGN PATENT DOCUMENTS

| | | | |
|---|---|---|---|
| EP | 0 512 940 | | 11/1992 |
| JP | 01272992 | A * | 10/1989 |
| JP | 02197756 | A * | 8/1990 |
| JP | 04218314 | A * | 8/1992 |
| JP | 7-16398 | | 1/1995 |
| JP | 4-126199 | | 4/1999 |
| JP | 11-137897 | | 5/1999 |
| JP | 2002-246000 | | 8/2002 |
| KR | 10-1995-0023775 | | 8/1995 |
| KR | 10-2006-0058496 | | 5/2006 |
| KR | 10-2006-0083424 | | 7/2006 |
| KR | 10-0652782 | | 11/2006 |

OTHER PUBLICATIONS

Korean Notice of Allowance dated Sep. 5, 2008. (App No. 10-2007-0038074).

Korean Notice of Allowance dated Sep. 5, 2008. (App No. 10-2007-0038076).

* cited by examiner

[FIG1]
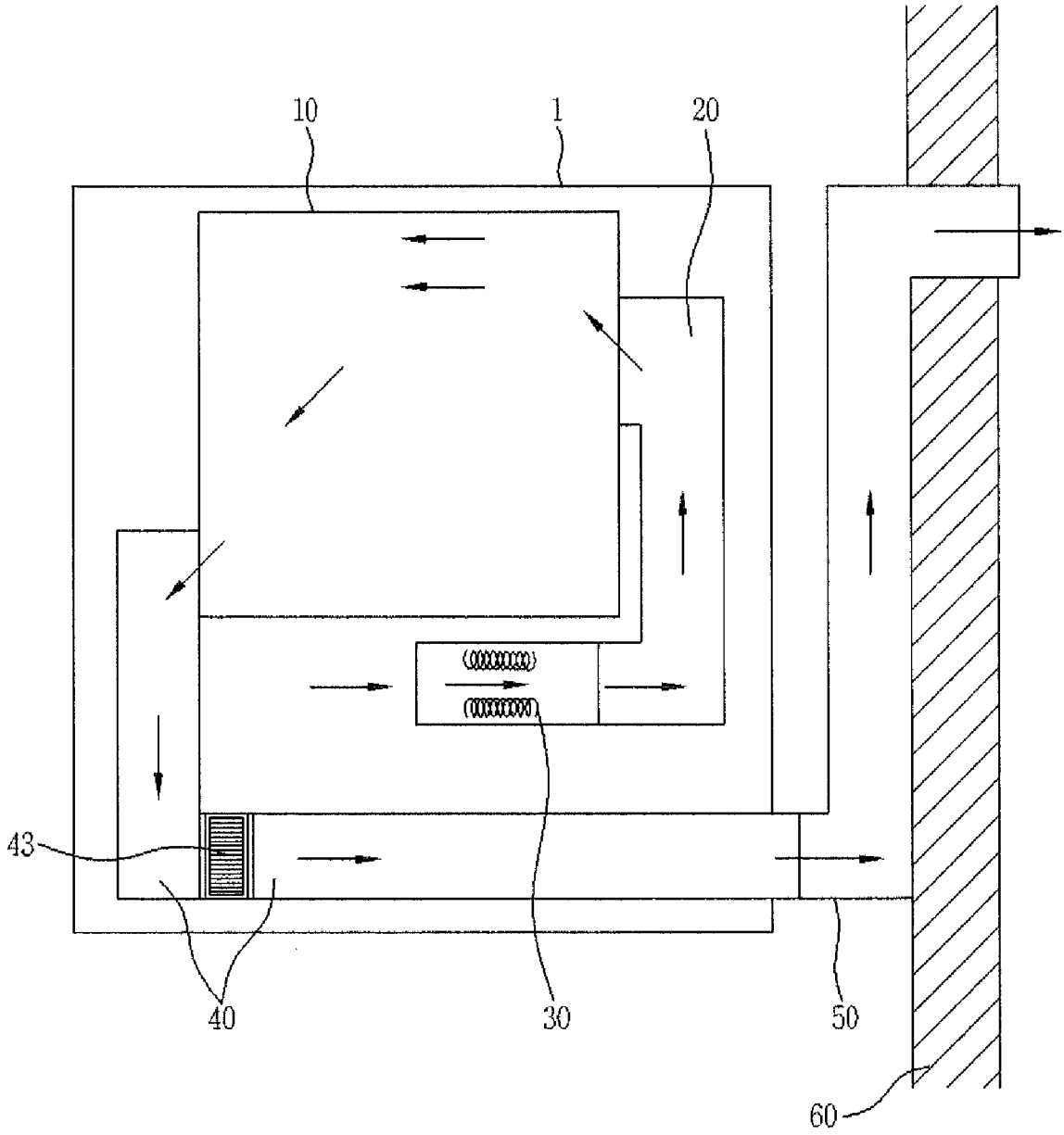

[FIG2]
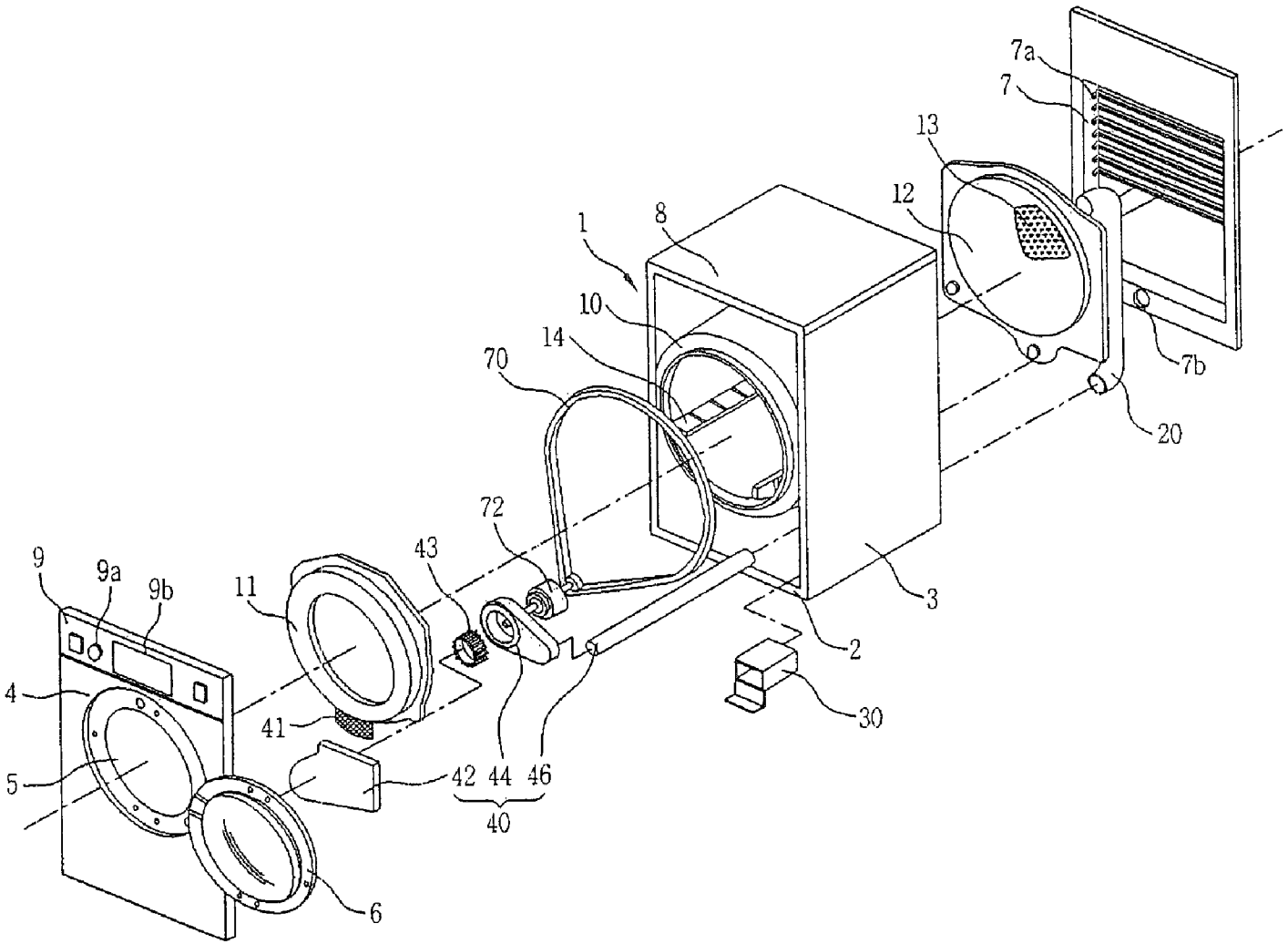

[FIG3]
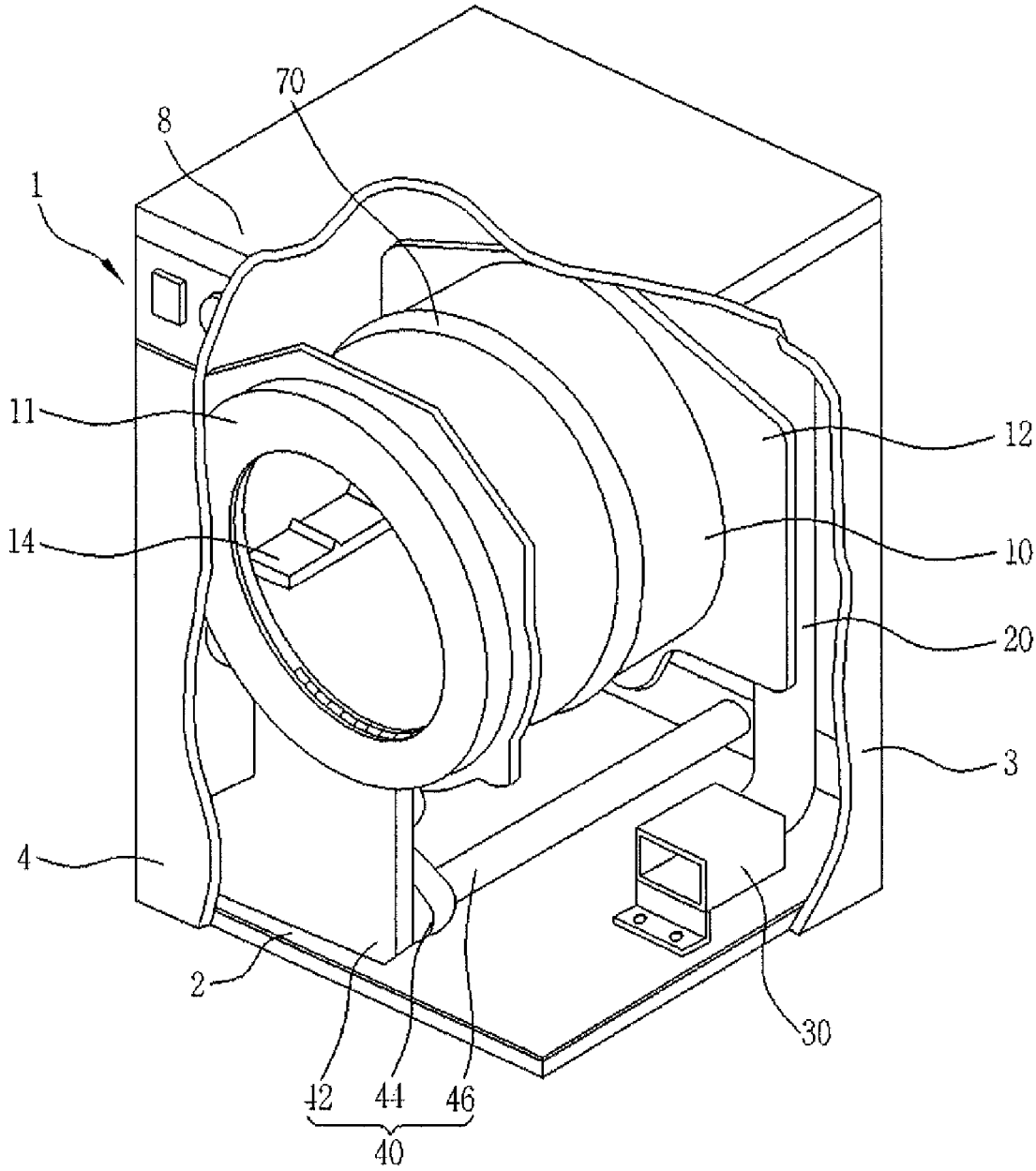

[FIG4]
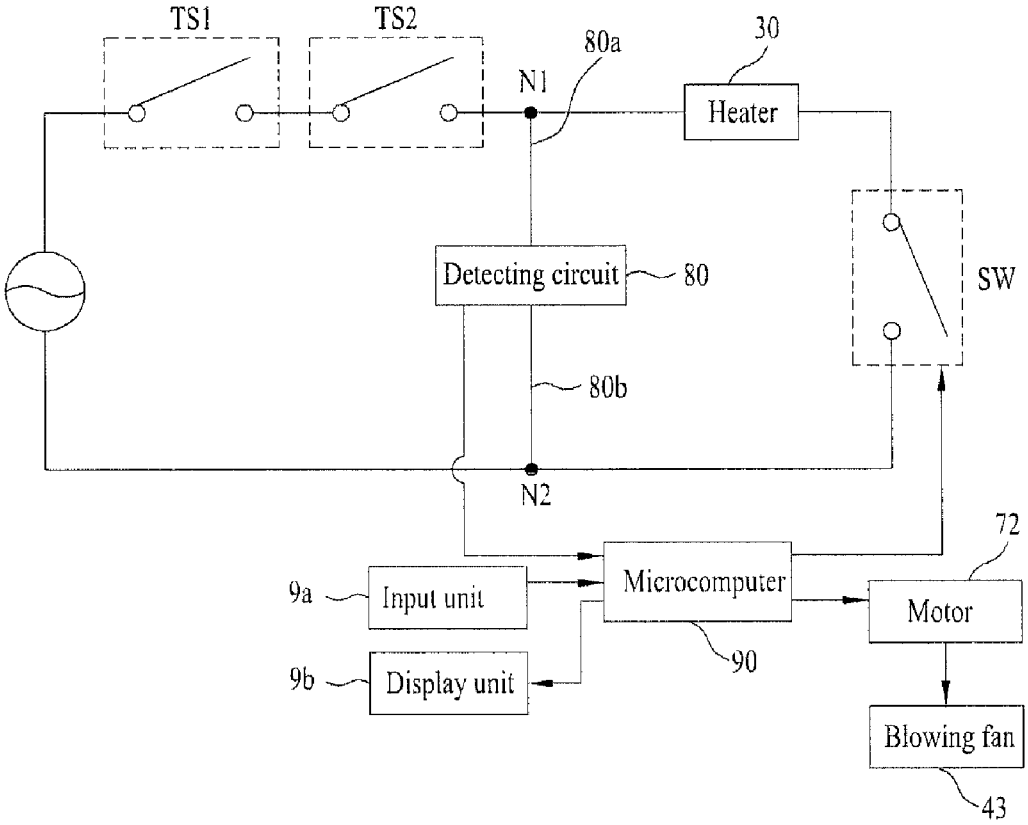
[FIG5]
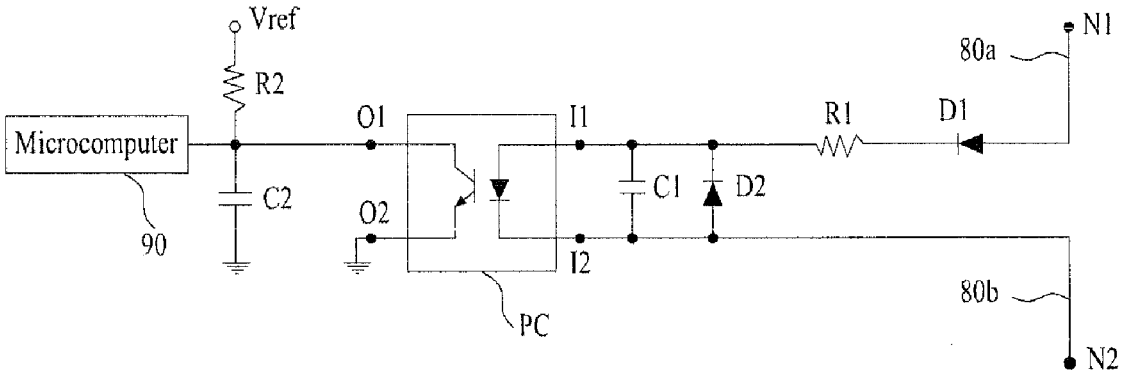

[FIG6]
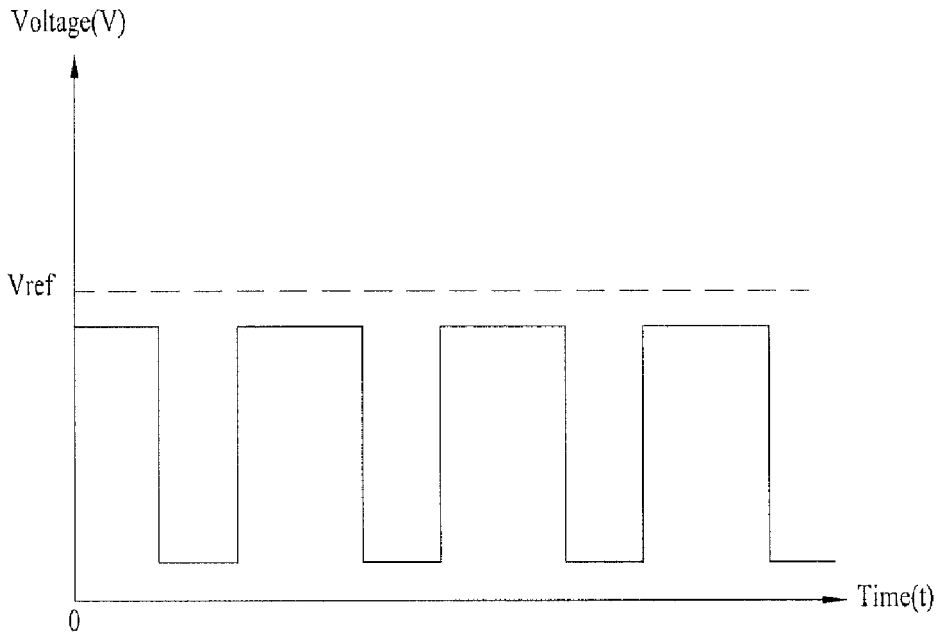
[FIG7]
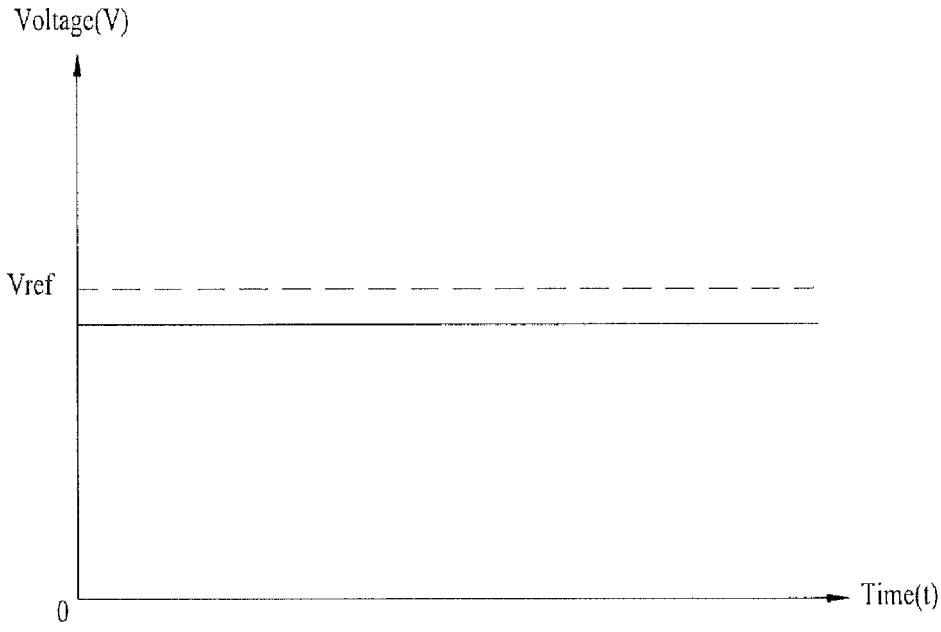

[FIG8]
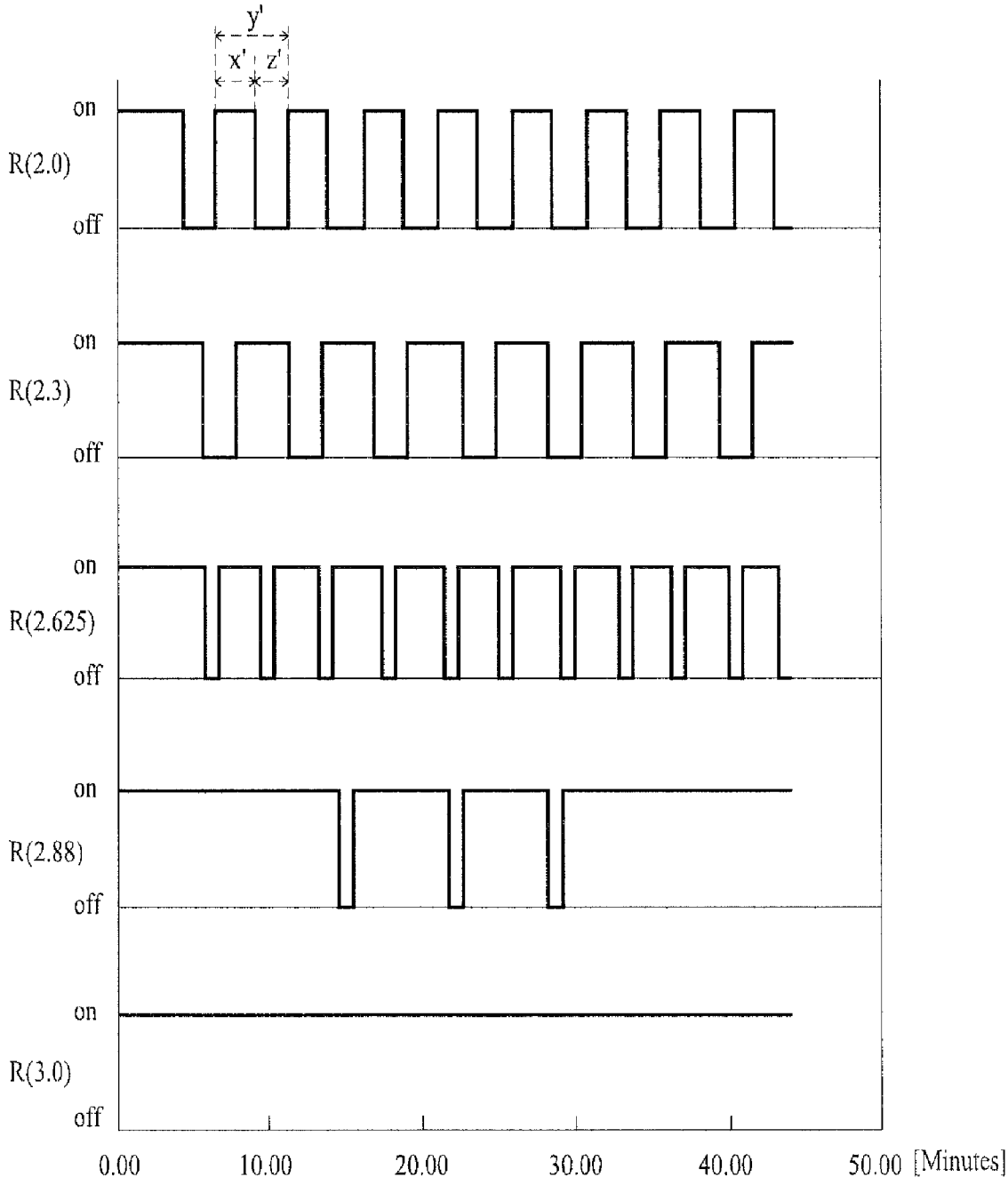

[FIG9A]
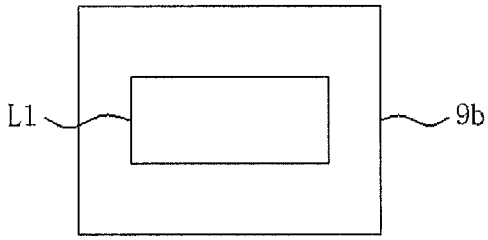
[FIG9B]
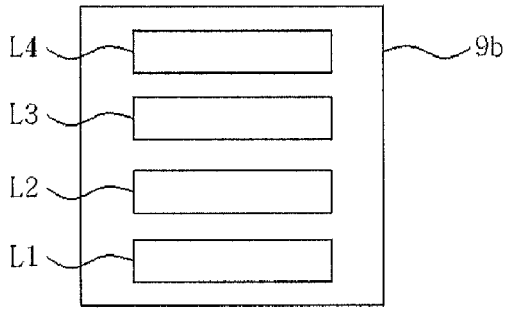
[FIG9C]
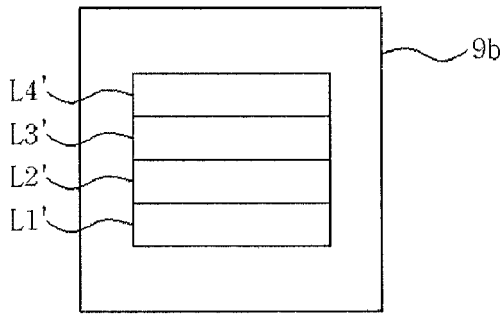

[FIG10A]
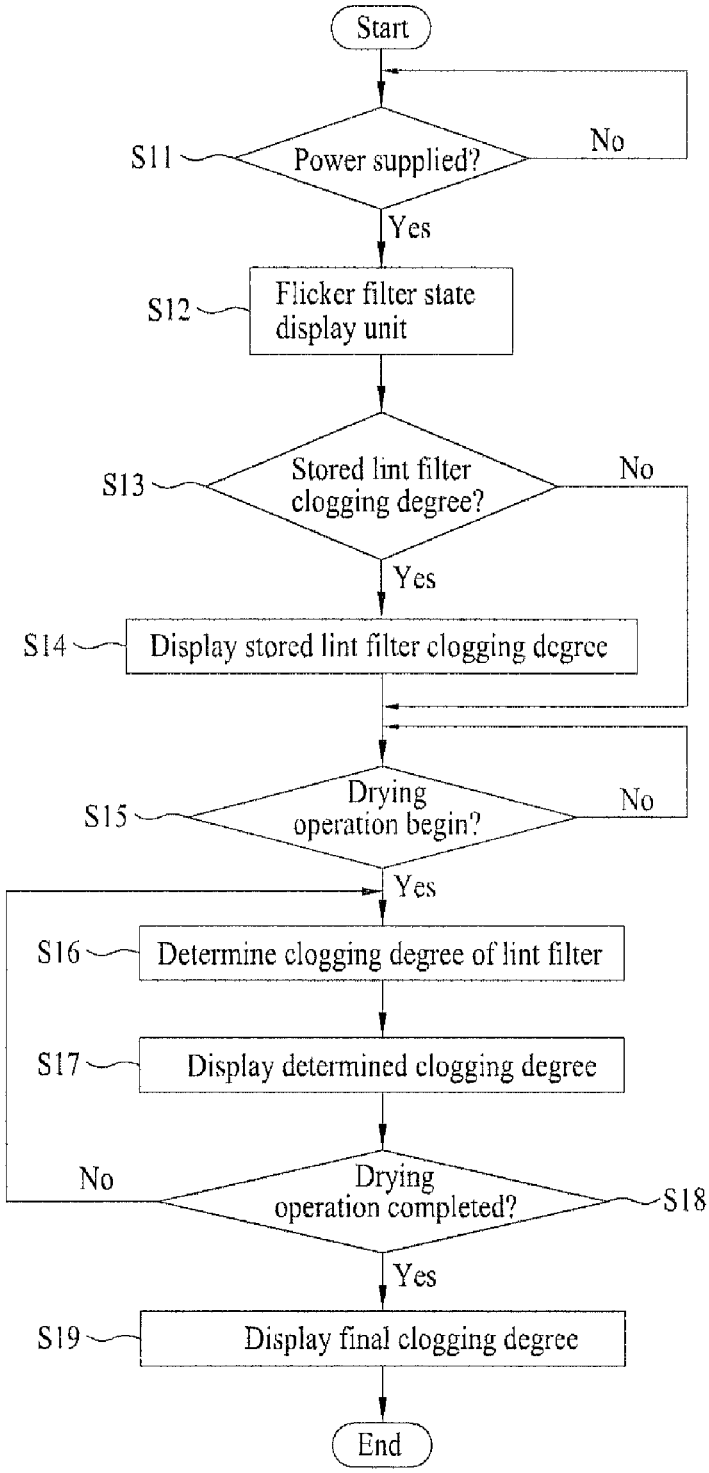

[FIG10B]
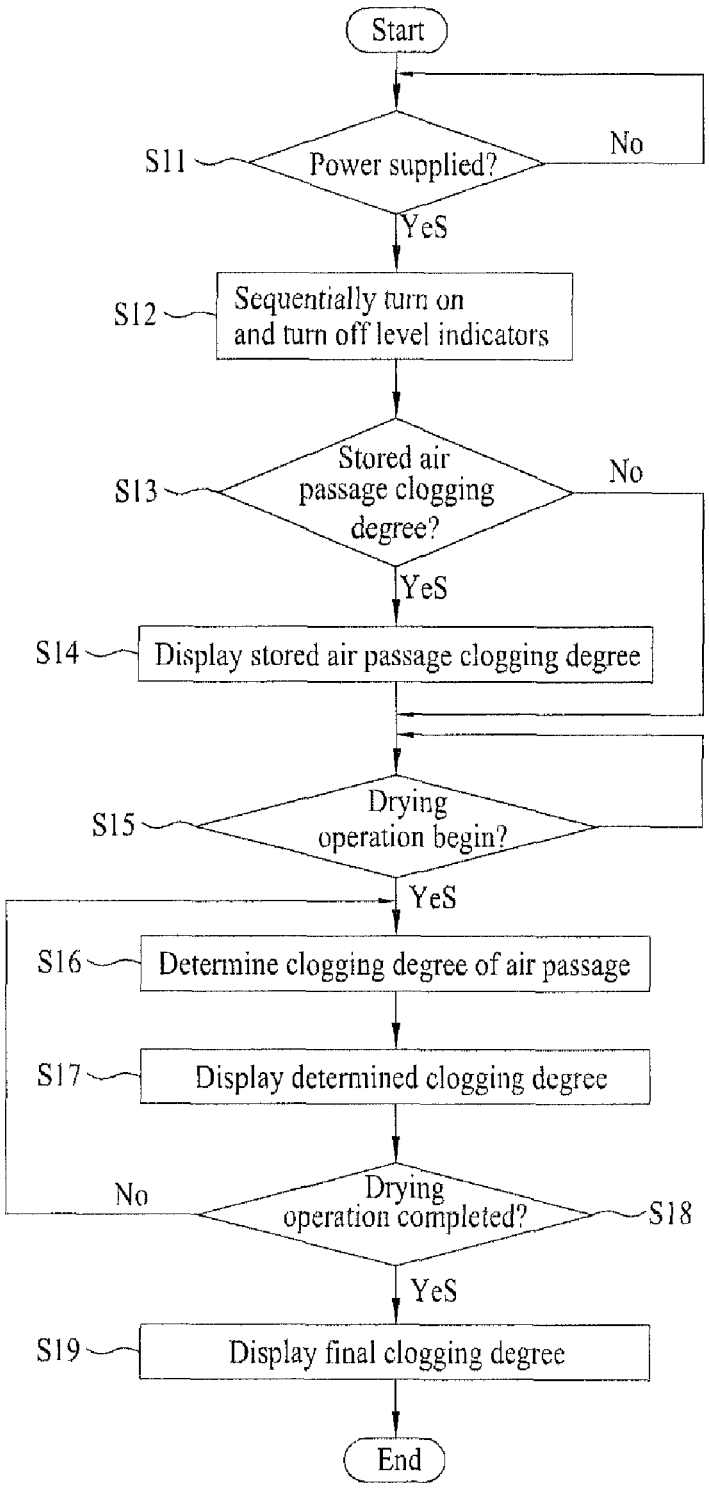

[FIG11A]
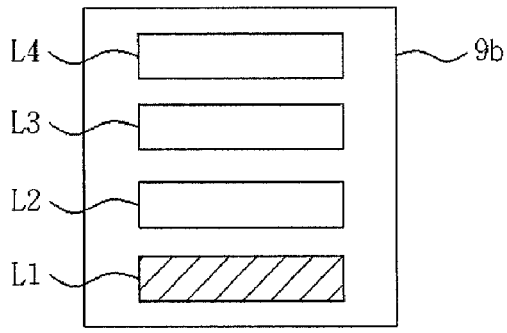
[FIG11B]
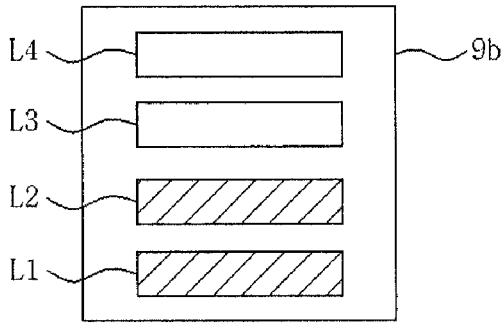
[FIG11C]
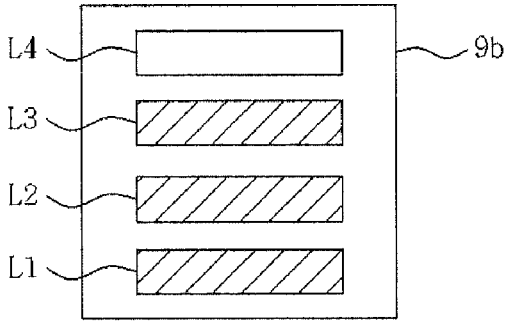

[FIG11D]
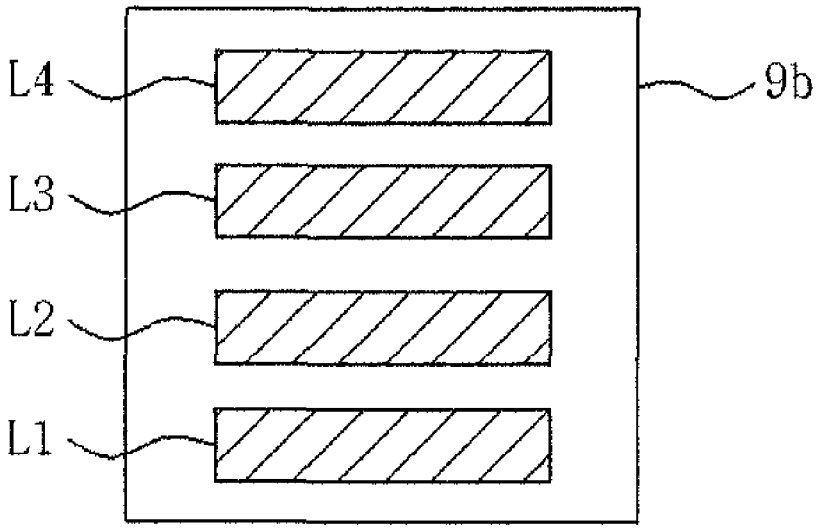
[FIG12]
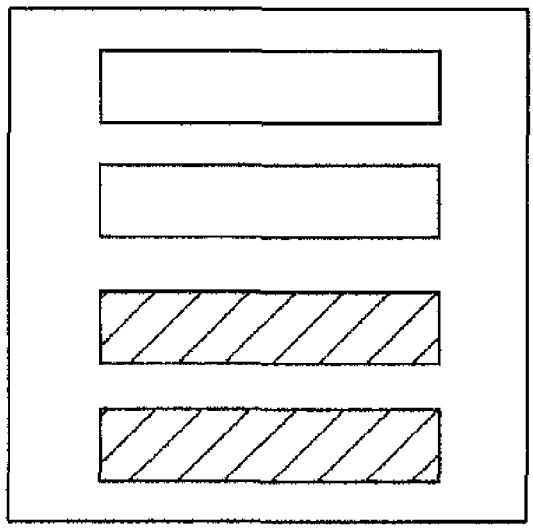

DISPLAY DEVICE OF DRYER

This application claims the benefit of Korean Patent Application Nos. 10-2007-0038074, filed on Apr. 18, 2007 & 10-2007-0038076 filed on Apr. 18, 2007, which are hereby incorporated by reference as if fully set forth herein.

BACKGROUND OF THE INVENTION

1. Field of the Invention

The present invention relates to a dryer, and more particularly to a display device for a dryer, which can achieve the reliability of a function to display a clogging degree in the dryer.

2. Discussion of the Related Art

Generally, a washing machine includes a body having a certain shape, a drum installed in the body, and a tub arranged to surround the drum. Wash water is collected in the tub. The washing machine also includes a drive motor for rotating the drum, a detergent box for supplying a detergent, a water supply pipe connected to the detergent box, to supply wash water alone or in a state of being mixed with the detergent supplied from the detergent box, and a drainage pipe for outwardly draining wash water used in a washing cycle. The washing machine further includes a pump and drainage hose, which are connected to an outer end of the drainage pipe, to forcibly drain the wash water.

The above-mentioned washing machine performs a washing operation using friction generated between laundry and wash water in the drum when the laundry falls by gravity during rotation of the drum. Recently, drum washing machines with various additional functions have been developed. For example, a drum washing machine, which has a drying function, not only to wash laundry, but also to dry laundry using hot air, has been developed.

Washing machines, which have a drying function as described above, are classified into a condensation type and an exhaustion type. In a condensation type washing machine, hot air generated from a heater is supplied to a drum by a blowing fan, to dry laundry contained in the drum. In this case, the air used to dry the laundry in the drum is in a hot and high-humid state. The air then flows to an air outlet communicating with a tub. At one side of the air outlet, a nozzle is arranged to inject cold water. By the nozzle, moisture is removed from the hot and high-humid air, to generate dry air, which is, in turn, supplied to the blowing fan.

In an exhaustion type washing machine, hot air generated from a heater and blown by a blowing fan flows to pass through laundry contained in a drum. The hot air is then exhausted to the outside of the washing machine through an exhaust port formed at one side of the washing machine. The exhaust port is connected to a bellows tube connected to a tub. The exhaust port also functions as a breath port when a baby or pet is confined in the washing machine.

In the washing machine, which has the above-mentioned exhaustion type drying function, lint may be produced from laundry during a drying operation. The lint is discharged to the outside of the washing machine through the exhaust port after circulating through the drum along with the hot air.

In order to prevent lint produced from laundry from being accumulated in the exhaust port, which functions to discharge lint to the outside of the washing machine, a structure capable of periodically collecting and removing lint is provided. For example, a lint filter is mounted in the exhaust port, in order to prevent the exhaust port from being clogged by lint when the washing machine is used for a prolonged period of time.

For the simplicity of description, the above-mentioned drying machines, which have a drying function, will be simply referred to as "dryers".

Such a conventional dryer recommends for the user to clean the filter whenever the dryer is used. However, the user may frequently neglect the filter cleaning due to inconvenience and troublesome caused by the cleaning. In this case, the clogging degree of the filter increases as the drying operation is repeated. For this reason, an increase in drying time and an increase in power consumption may occur. When the clogging degree is excessive, lint may float in the drum without being collected by the filter, and may then be attached to the laundry and the inner surface of the dryer. In this case, the laundry may be contaminated by the lint. Furthermore, in the exhaustion type dryer, lint may be accumulated in the exhaust port functioning to exhaust air, which has been used to dry laundry, to the outside of the dryer, so that the lint may interfere with a flow of air. In this case, it is very difficult for the user to recognize such clogging of the exhaust port.

SUMMARY OF THE INVENTION

Accordingly, the present invention is directed to a display device of a dryer that substantially obviates one or more problems due to limitations and disadvantages of the related art.

An object of the present invention is to provide a display device and a display method in a dryer, which are capable of displaying a clogging degree of an air passage used in a drying operation of the dryer.

Another object of the present invention is to provide a display device and a display method in a dryer, which are capable of displaying a normal operation state of a display when power is applied to the dryer.

Another object of the present invention is to provide a display device and a display method in a dryer, which are capable of visually inducing the user to recognize a clogging degree of an air passage used in a drying operation of the dryer, thereby increasing effects of recognizing the clogging degree of the air passage.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a display device of a dryer comprises: a display unit for displaying a clogging degree of an air passage through at least one level indicator; and a controller for controlling the display unit when power is supplied, such that the level indicator flickers for a predetermined time, and then displays the clogging degree of the air passage.

The at least one level indicator may comprise a plurality of level indicators, and the controller controls the display unit such that the level indicators are sequentially turned on, and then sequentially turned off, and at least one of the level indicators then displays the clogging degree of the air passage.

The controller may turn on or off the level indicators at intervals of a predetermined time.

The level indicators may be aligned while being uniformly spaced apart from one another.

The clogging degree of the air passage may comprise at least one of a clogging degree of an exhaust duct, and a clogging degree of a lint filter.

The controller may control the display unit to display the clogging degree of the air passage until the supply of the power is cut off.

In another aspect of the present invention, a method for displaying a clogging degree in a dryer comprises: first displaying to flicker a display unit for a predetermined time when power is supplied; and second displaying to turn on the display unit, to display a clogging degree of an air passage.

The second displaying step may be executed when the clogging degree of the air passage is higher than a critical clogging value.

The first displaying step may be executed such that a plurality of level indicators are sequentially turned on and then sequentially turned off.

The first displaying step may be executed such that the turning-on or turning-off of the level indicators is carried out at intervals of a predetermined time.

The second displaying step may be continued until the supply of the power is cut off.

The second displaying step may be executed during an execution of a drying operation.

The clogging degree of the air passage may comprise at least one of a clogging degree of an exhaust duct, and a clogging degree of a lint filter.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 1 is a sectional view of a dryer according to the present invention;

FIG. 2 is an exploded perspective view of the dryer according to the present invention;

FIG. 3 is a partially-broken perspective view of the dryer according to the present invention;

FIG. 4 is a circuit configuration of a display device used in the dryer in accordance with the present invention;

FIG. 5 is a circuit diagram illustrating an exemplary embodiment of a detecting circuit shown in FIG. 4;

FIGS. 6 and 7 are waveform diagrams of outputs from the detecting circuit;

FIG. 8 is a waveform diagram depicting waveforms of detect signals recognized by a microcomputer;

FIGS. 9A to 9C are schematic views illustrating embodiments of a display unit in the display device, respectively;

FIG. 10A is a flow chart illustrating an exemplary embodiment of a display method for the dryer according to the present invention;

FIG. 10B is a flow chart illustrating another embodiment of the display method for the dryer according to the present invention;

FIGS. 11A to 11D are schematic views illustrating examples of sequential turning-on/off operations of the display device;

FIG. 12 is a schematic view illustrating an example of the operation of the display device to display a clogging degree.

DETAILED DESCRIPTION OF THE INVENTION

Reference will now be made in detail to the preferred embodiments of the present invention associated with, for example, a dryer, examples of which are illustrated in the accompanying drawings. However, the scope of the present invention is not limited to the following embodiments and drawings. The scope of the present invention is limited only to the contents defined in the claims, which will be described later.

FIG. 1 is a sectional view of a dryer according to the present invention. FIG. 2 is an exploded perspective view of the dryer according to the present invention. FIG. 3 is a partially-broken perspective view of the dryer according to the present invention. The following description will be given in conjunction with an embodiment in which the present invention is applied to an exhaustion type dryer. However, the present invention is not limited to the exhaustion type dryer.

As shown in FIG. 1, the exhaustion type dryer according to the illustrated embodiment includes a cabinet 1, a drum 10 arranged in the cabinet 1, to contain laundry, a suction passage 20 formed to suck air into the drum 10, a heater 30 arranged in the suction passage 20, and an exhaust passage 40 formed to exhaust the air emerging from the drum 10 to the outside of the cabinet 1. In the case of this exhaustion type dryer, an external exhaust duct 50, which extends through an inner wall 60 of a building, is connected to the exhaust passage 40, to outwardly exhaust the air.

A blowing fan 43 is arranged in one of the suction passage 20 and exhaust passage 40. The following description will be given only in conjunction with the case in which the blowing fan 43 is arranged in the exhaust passage 40.

As shown in FIGS. 2 and 3, the cabinet 1 includes a base panel 2, a cabinet body 3 installed on the base panel 2, a cabinet cover 4 mounted to a front side of the cabinet body 3, a back panel 7 mounted to a back side of the cabinet body 3, and a top cover 8 mounted to a top side of the cabinet body 3. The cabinet 1 also includes a control panel 9 mounted to an upper end portion of the cabinet cover 4.

As shown in FIG. 2, a laundry loading/unloading hole 5 is formed through the cabinet cover 4. A door 6 is pivotally connected to the cabinet cover 4, in order to open or close the laundry loading/unloading hole 5. The control panel 9, which is mounted to the upper end portion of the cabinet cover 4, includes an input unit 9*a* for acquiring an input from the user, and a display unit 9*b* for displaying a state of the dryer (including, for example, a drying operation progress, a drying degree, a residual drying time, a selected drying mode, etc.). A front supporter 11 is mounted to a rear surface of the cabinet cover 4, to rotatably support a front end of the drum 10.

A rear supporter 12 is mounted to a front surface of the back panel 7, to rotatably support a rear end of the drum 10. A communicating hole 13 is formed through the rear supporter 12, to communicate the suction passage 20 with an inlet of the drum 10, and thus enabling air emerging from the suction passage 20 to be introduced into the inlet of the drum 10.

As shown in FIGS. 2 and 3, the drum 10 has a cylindrical barrel structure forwardly and rearwardly opened to allow air to flow in forward and rearward directions while having a space to contain laundry. The drum 10 has a rear opening forming the inlet of the drum 10, and a front opening forming the outlet of the drum 10. In the drum 10, a lift 14 is mounted to an inner peripheral surface of the drum 10 such that the lift 14 is inwardly protruded, to raise laundry and then to allow the raised laundry to fall during rotation of the drum 10.

The suction passage 20 is defined by a suction duct having a lower end communicating with a rear end of the heater 30, and an upper end communicating with the communicating hole 13 of the rear supporter 12.

As shown in FIGS. 2 and 3, the heater 30 includes a heater case mounted on an upper surface of the base panel 2 while communicating with the suction passage 20, namely, the suction duct, and a heating coil arranged in the heater case. When electric power is supplied to the heating coil, the heater case and the interior of the heater case are heated. As a result, air passing through the interior of the heater case is heated, so that it becomes hot air having low humidity.

As shown in FIGS. 2 and 3, the exhaust passage 40 is defined by a lint duct 42, a fan housing 44, and an exhaust pipe 46. The lint duct 42 is arranged to communicate with the outlet of the drum 10, in order to allow air from the drum 10 to be exhausted. A lint filter 41 is arranged in the lint duct 42, to filter out foreign matter, such as lint, from the exhausted air. The fan housing 44 communicates with the lint duct 42. The blowing fan 43 is arranged in the fan housing 44. The exhaust pipe 46 has one end communicating with the fan housing 44, and the other end extending outwardly through the cabinet 1. The external exhaust duct 50 is connected to the exhaust pipe 46, to guide the air outwardly exhausted from the cabinet 1 to the outdoors. The external exhaust duct 50 is formed at the outside of the cabinet 1, in order to guide air to the outdoors. The external exhaust duct 50 may extend through the building inner wall 60.

An air passage used in the present invention includes the suction passage 20, the inner space of the drum 10, the exhaust passage 40, and the external exhaust duct 50. Clogging of the air passage occurs mainly at the lint filter 41 of the exhaust passage 40 and in the external exhaust duct 50. The influence of the air flow interference caused by the clogging of the lint filter 40 in the exhaust passage 40 is relatively small, as compared to the influence of the air flow interference caused by the clogging of the external exhaust duct 50.

Hereinafter, operation of the exhaustion type dryer according to the illustrated embodiment of the present invention will be described.

The user closes the door 6 after loading laundry into the drum 10, and then operates the control panel 9, in order to operate the exhaustion type dryer. In accordance with the operation of the exhaustion type dryer, the heater 30 is turned on, and the motor 72 is driven.

When the heater 30 is in an ON state, it heats the interior thereof. As the motor 72 is driven, the blowing fan 43 and a belt 70 are rotated. In accordance with the rotation of the belt 70, the drum 10 is rotated. As a result, the laundry loaded in the drum 10 repeats operations of being raised by the lift 14, and then dropped.

During the rotation of the blowing fan 43, ambient air around the cabinet 1 is sucked into an air suction hole 7*a* formed through the back cover 7 by a blowing force generated in accordance with the rotation of the blowing fan 43. The sucked air is then guided between the cabinet 1 and the drum 10. The air introduced between the cabinet 1 and the drum 10 is introduced into the heater 30 which, in turn, heats the introduced air. As the air is heated, it comes into a state of high temperature and low humidity. Subsequently, the heated air is introduced into the drum 10 via the suction passage 20 and the communicating hole 13 of the rear supporter 12.

The hot and low-humid air introduced into the drum 10 comes into contact with the laundry as it flows forwardly in the drum 10, so that it comes into a high humid state. Thereafter, the air is introduced into the exhaust passage 40.

The air introduced into the exhaust passage 40 is guided by the exhaust pipe 46 such that it is outwardly exhausted through the external exhaust duct 50.

FIG. 4 is a circuit configuration of a display device used in the dryer in accordance with the present invention. The display device shown in FIG. 4 includes first and second thermostats TS1 and TS2, each of which receives external commercial power, and supplies the received commercial power to the heater 30. Each of the first and second thermostats TS1 and TS2 is turned on/off in accordance with the temperature of the heater 30 or the temperature of air heated by the heater 30. In the following description, the first and second thermostats may also be simply referred to as "temperature control members". The display device also includes a switch SW turned on/off in accordance with a control command from a microcomputer 90, to selectively apply the commercial power to the heater 30. The input unit 9*a* and display unit 9*b* are also included in the display device. The display device further includes a detecting circuit 80 for detecting whether or not power is supplied to the heater 30, in accordance with the ON/OFF states of the first and second thermostats TS1 and TS2. The microcomputer 90, which is also included in the display device, determines whether or not the first and second thermostats TS1 and TS2 are in an ON state, based on the power supply ON/OFF state detected by the detecting circuit 80. Although not shown, a power supply is also provided to supply DC power converted from the commercial power to the microcomputer 90, input unit 9*a*, and display unit 9*b*. The power supply is well known by those skilled in the technical field to which the present invention pertains.

The first and second thermostats TS1 and TS2 function as controllers operating in accordance with temperature. The first and second thermostats TS1 and TS2 are mounted at one side of the heater 30 or in the vicinity of the heater 30. The first and second thermostats TS1 and TS2 respond to the temperature of the heater 30 or the temperature of air heated by the heater 30. Each of the first and second thermostats TS1 and TS2 is maintained in an ON state until it senses a predetermined overheating temperature. When the first or second thermostat TS1 or TS2 senses a temperature exceeding the predetermined overheating temperature, it is transited to an OFF state, thereby cutting off the supply of the commercial power to the heater 30. In particular, once the first thermostat TS1 is transited to an OFF state, it does not return to an ON state, in order to assist the second thermostat TS2. The first and second thermostats TS1 and TS2 are mounted to, for example, the suction passage 20 connected to the heater 30.

The switch SW is constituted by an element such as a relay. The switch SW is maintained in an ON state during a drying operation in accordance with an ON-control operation of the microcomputer 90, while being maintained in an OFF state in accordance with an OFF-control operation of the microcomputer 90.

The input unit 9*a* receives control commands input from the user in association with the drying operation, and applies the control commands to the microcomputer 90.

The display unit 9*b* displays the control commands input from the user in association with the drying operation, the drying operation progress, the residual drying time, the clogging degree of the air passage, the clogged position, etc. The display unit 9*b* may be implemented by an LED element or an LCD element. In the present invention, the air passage includes the suction passage 20, the inner space of the drum 10, the exhaust passage 40, and the external exhaust duct 50.

In particular, the air passage may designate the lint filter 41 of the exhaust passage 40 and the external exhaust duct 50.

The display unit 9*b* may display the clogging degree of the lint filter 41 and the clogging degree of the exhaust duct 50 in a separate manner.

In order to display such a clogging degree, the display unit 9*b* may include a single level indicator to display a single clogging level. Alternatively, the display unit 9*b* may include a plurality of level indicators to display at least two clogging levels. As such a level indicator turns on or off, or flickers, it can display an associated clogging degree.

In the case of the single level indicator, it displays a clogging state when the current clogging degree exceeds a critical clogging value. On the other hand, for the plurality of level indicators, different critical clogging values are set, respectively. In this case, accordingly, the current clogging degree is displayed by the level indicator, which has a critical clogging value corresponding to the current clogging degree, or by the level indicators, which have critical clogging values not higher than the current clogging degree.

The detecting circuit 80 is connected to nodes N1 and N2, to detect whether or not current flows through a DC circuit including the heater 30, namely, whether or not power is supplied to the heater 30. For this determination, the detecting circuit 80 is connected to the nodes N1 and N2 by connecting lines 80*a* and 80*b*, respectively. The detecting circuit 80 is mounted on the control panel 9, on which the microcomputer 90 is also mounted. Accordingly, the connecting lines 80*a* and 80*b* extend along the inner space between the drum 10 and the cabinet body 3 or along the inner surface of the cabinet body 3.

In detail, the detecting circuit 80 detects whether or not power is supplied to the heater 30 in accordance with ON/OFF operations of the first and second thermostats TS1 and TS2 responding to the temperature of the heater 30 or the temperature of air heated by the heater 30. Of course, the supply of power to the heater 30 is also controlled by the switch SW. However, the switch SW operates under the control of the microcomputer 90. Accordingly, the microcomputer 90 determines whether or not power is supplied to the heater 30, based on a detect signal from the detecting circuit 80, in an ON state of the switch SW. When the switch SW is in an OFF state under the control of the microcomputer 90, the microcomputer does not take into consideration the detect signal from the detecting circuit 80.

The detecting circuit 80 sends a detect signal corresponding to a power supply or cutoff state to the microcomputer 90, so as to enable the microcomputer 90 to identify the power supply or cutoff state, based on the detect signal. Different from the circuit configuration shown in FIG. 4, the detecting circuit 80 may have input terminals respectively connected between the first thermostat TS1 and a commercial power source and between the heater 30 and the switch SW. In the case of a DC circuit including the first and second thermostats TS1 and TS2, heater 30, and switch SW, it is possible to most clearly identify the voltage difference generated across the heater 30 when commercial power is supplied. Accordingly, the connection of the detecting circuit 80 is achieved to always detect a voltage difference generated in a circuit including the heater 30.

As described above, the microcomputer 90 basically controls the heater 30, switch SW, and motor 72 in accordance with a command input from the user through the input unit 9*a*, and controls the blowing fan 43 in accordance with the control for the motor 72, for the execution of a desired drying operation. The microcomputer 90 is also equipped with a storage (not shown) to store a control algorithm for the above-described control operations. For the storage, for example, an EEPROM may be used.

The microcomputer 90 and detecting circuit 80 are mounted to a back surface of the above-described control panel 9.

The microcomputer 90 also determines information as to the power supply or cutoff carried out by the first and second thermostats TS1 and TS2 in accordance with the detect signal from the detecting circuit 80.

FIG. 5 illustrates an exemplary embodiment of the detecting circuit shown in FIG. 4. As shown in FIG. 5, the detecting circuit 80 includes a diode D1 for passing a positive (+) component of an input voltage from the node N1, a resistor R1 for reducing the input voltage from the node N1, and a photocoupler PC to turn on/off in accordance with the input voltage. The detecting circuit 80 also includes a diode D2 and a capacitor C1 to prevent noise components of the input voltage from being applied to input terminals 11 and 12 of a photocoupler PC. The detecting circuit 80 further includes a resistor R2 and a capacitor C2, which are connected to an output terminal O1 of the photocoupler PC, to provide, to the microcomputer 90, a DC voltage lower than a reference voltage Vref in accordance with an ON or OFF state of the photocoupler PC. The DC voltage has different waveforms respectively corresponding to the ON and OFF states of the photocoupler PC. The reference voltage Vref is used as a drive voltage for the microcomputer 90 in the circuit, which includes the microcomputer 90. Although no description will be given of a voltage source for generating the reference voltage Vref, this voltage source is well known by those skilled in the technical field to which the present invention pertains.

Where the commercial power has a voltage of, for example, AC 240V, the voltage difference between the node N1 and the node N2. When this voltage is directly applied to the photocoupler PC, the photocoupler PC may be damaged. To this end, the resistor R1 is used to reduce the input voltage to a several ten V.

When there is a voltage difference between the node N1 and the node N2, namely, when the first and second thermostats TS1 and TS2 turn on to enable power to be supplied to the heater 30, a voltage corresponding to the voltage difference is applied to the input terminals 11 and 12 of the photocoupler PC. Since the applied voltage is an AC voltage, a photodiode, which is included in the photocoupler PC, as a light emitter, periodically emits light in accordance with the cycle of the voltage. Accordingly, a transistor, which is also included in photocoupler PC, as a light receiver, is periodically turned on/off. As a result, a square wave is applied to the microcomputer 90. On the other hand, when there is no voltage difference between the node N1 and the node N2, namely, when the first and second thermostats TS1 and TS2 turn off to prevent power from being supplied to the heater 30, the input terminals 11 and 12 of the photocoupler PC are maintained at the same voltage level. The photodiode of the photocoupler PC does not emit light, so that the transistor of the photocoupler PC is maintained in an OFF state. As a result, a DC voltage waveform approximate to the reference voltage Vref is continuously applied to the microcomputer 90.

FIGS. 6 and 7 are graphs depicting output waveforms of the detecting circuit, respectively. When the first and second thermostats TS1 and TS2 are in an ON state, the commercial power, which has an AC voltage, is applied to the heater 30. Accordingly, a voltage difference corresponding to the AC voltage of the commercial power is generated between the node N1 and the node N2. In accordance with this voltage difference, the photocoupler PC is turned on. Due to the AC voltage, however, the photocoupler PC is repeatedly turned on and off in accordance with the cycle of the commercial power. As a result, a square wave lower than the reference voltage Vref is applied to the microcomputer 90, as shown in FIG. 6.

On the other hand, when the first and second thermostats TS1 and TS2 are in an OFF state, no power is supplied to the heater 30. Accordingly, the nodes N1 and N2 are maintained at the same voltage level, so that the photocoupler PC is maintained in an OFF state. As a result, a DC voltage (for example, a high signal) approximate to the reference voltage Vref is continuously applied to the microcomputer 90, as shown in FIG. 7.

Thus, the microcomputer 90 can calculate the time, for which the power supply to the heater 30 is cut off in accordance with the OFF state of the first and second thermostats TS1 and TS2, based on the waveform of the DC voltage applied to the microcomputer 90.

FIG. 8 depicts waveforms of detect signals recognized by the microcomputer. In FIG. 8, "R" represents the diameter of the exhaust duct 50, and the unit of the diameter R is in inches. The waveforms of FIG. 8 represent detect signals generated from the detecting circuit 80, as shown in FIG. 6 or 7, and recognized by the microcomputer as power supply/cutoff state information, namely, ON/OFF information, for diameters of R(2.0), R(2.3), R(2.625), R(2.88), and R(3.0), respectively. Referring to FIG. 8, it can be seen that the air flow interference (clogging degree) in the air passage is lower at a larger diameter, and is higher at a smaller diameter.

In order to determine the clogging degree of the air passage, a determination method using a power supply ON/OFF duty ratio is used in accordance with the present invention. In the illustrated embodiment, one or either of an ON duty ratio (x'/y') or an OFF duty ratio (z'/y') may be used. The following description will be given in conjunction with the OFF duty ratio (z'/y').

The OFF duty ratio of the case "R(2.0)" is 0.48 (ON duty ratio is 0.52), the OFF duty ratio of the case "R(2.3)" is 0.32 (ON duty ratio is 0.68), the OFF duty ratio of the case "R(2.625)" is 0.26 (ON duty ratio is 0.74), the OFF duty ratio of the case "R(2.88)" is 0.13 (ON duty ratio is 0.87), and the OFF duty ratio of the case "R(3.0)" is 0 (ON duty ratio is 1). That is, it can be seen that the OFF duty ratio increases as the diameter decreases. On the other hand, the ON duty ratio decreases. Thus, the microcomputer 90 can determine the clogging degree of the air passage (in particular, the clogging degree of the lint filter 41 or exhaust duct 50) by calculating the OFF duty ratio. Results of an experiment measuring the clogging degree of the air passage are described in the following Table 1.

TABLE 1

| OFF Duty Ratio | Clogging Degree | Clogging Position |
|---|---|---|
| 0 to 0.30 | — | — |
| 0.30 to 0.45 | Low (Slight) | Lint filter |
| 0.45 to 0.60 | Medium (Medium) | Lint filter (severely clogged)/Exhaust duct (medially clogged) |
| 0.60 or more | High (Severe) | Exhaust Duct |

The microcomputer 90 stores air passage clogging information acquired based on the above-described ON/OFF duty ratio. The storing operation is repeatedly carried out in accordance with the number of drying operations carried out in the dryer 1. In particular, when the dryer 1 is initially installed, or is re-installed due to house-moving or other reasons, the microcomputer 90 initially stores an initial clogging degree of the air passage, more accurately, an initial clogging degree of the exhaust duct 50, and additionally stores a clogging degree according to a subsequent drying operation whenever the drying operation is carried out. For example, the microcomputer 90 stores a value D0 as an initial clogging degree, and values D1, D2, . . . , Dn−1, and Dn as subsequent clogging degrees.

FIGS. 9A to 9C illustrate embodiments of the display unit in the display device.

In the case of FIG. 9A, the display unit 9*b* includes a single level indicator L1. The display unit 9*b* displays the current clogging degree in such a manner that the level indicator L1 turns on or flickers when the current clogging degree is higher than a critical clogging value (for example, an OFF duty ratio of 0.45).

In the case of FIG. 9B, the display unit 9*b* includes a plurality of level indicators L1 to L4 aligned while being uniformly spaced apart from one another. The display unit 9*b* may be controlled such that the level indicators L1 to L4 turn on and off in a simultaneous or sequential manner, or selected one or more of the level indicators L1 to L4 flicker.

In the case of FIG. 9C, the display unit 9*b* includes a plurality of level indicators L1' to L4' aligned without being spaced apart from one another. The display unit 9*b* may be controlled such that the level indicators L1' to L4' turn on and off in a simultaneous or sequential manner, or selected one or more of the level indicators L1' to L4' flicker.

If the air passage is in a normal state in terms of clogging, namely, if there is no substantial clogging degree required to be displayed, the level indicator L1 or level indicators L1 to L4 or L1' to L4' are in an OFF state in accordance with the above-described configuration in each of the cases shown in FIGS. 9A, 9B, and 9C. In this case, it is difficult for the user to surely identify the fact that the level indicator OFF state represents the normal state of the air passage under the normal operation of the display unit 9*b*. In other words, even when the level indicator OFF state is caused by a failure of the level indicator L1 or one of the level indicators L1 to L4 or L1' to L4, in spite of substantial clogging, the user may recognize the level indicator OFF state as the normal state of the air passage. To this end, it is necessary to clearly inform the user of whether or not the display unit 9*b* operates normally.

FIG. 10A is a flow chart illustrating an exemplary embodiment of a display method for the dryer according to the present invention.

In accordance with the display method, the microcomputer 90 determines whether or not commercial power is applied, at step S11. When commercial power is applied, the microcomputer 90 proceeds to step S12.

At step S12, the microcomputer 90 controls the display unit 9*b* such that the level indicator L1 or each of the level indicators L1 to L4 or L1' to L4' flickers for a predetermined time, to enable the user to recognize a normal operation of the display unit 9*b*. After flickering, the level indicator L1 or each of the level indicators L1 to L4 or L1' to L4' are turned off.

At step S13, the microcomputer 90 determines whether or not there is a stored air passage clogging degree (in particular, a stored clogging degree or state for the lint filter 42). If there is a stored air passage clogging degree, the microcomputer 90 proceeds to step S14. If not, the microcomputer 90 proceeds to step S15.

At step S14, the microcomputer 90 displays the stored air passage clogging degree through the display unit 9*b*. In the case of FIG. 9A, the display unit 9*b* turns on the level indicator L1 when the stored air passage clogging degree is higher than the critical clogging value of the level indicator L1, to display the stored air passage clogging degree. In the case of FIG. 9B or 9C, the display unit 9*b* turns on, from among the level indicators L1 to L4 or L1' to L4', the level indicator, which has a critical clogging value corresponding to the stored air passage clogging degree, or the level indicators, which have critical clogging values not higher than the stored air passage clogging degree, to display the stored air passage clogging degree. The stored clogging degree is displayed following step S12. That is, the display of the stored clogging degree is carried out under the condition in which the user has been visually induced to observe the display unit 9*a*, by step S12. Thus, the user can more surely recognize the displayed clogging degree.

At step S15, the microcomputer 90 determines whether or not a drying operation begins in accordance with a drying operation start command input from the user through the input unit 9*a* or in accordance with a predetermined algorithm. When the drying operation begins, the microcomputer 90 proceeds to step S16.

At step S16, the microcomputer 90 determines ON/OFF states of the temperature control members in accordance with a detect signal from the detecting circuit 80, and calculates an ON/OFF duty ratio, based on the determined ON/OFF states. Based on the calculated ON/OFF duty ratio, the microcomputer 90 determines the clogging degree, clogging progress, or clogging state of the air passage.

If the determined clogging degree is higher than the currently-displayed clogging degree, the microcomputer 90 displays, at step S17, the determined clogging degree through the display unit 9*b*. If there is no clogging degree currently displayed, in this case, the microcomputer 90 displays the determined clogging degree through the display unit 9*b*.

At step S18, the microcomputer 90 determines whether or not the drying operation has been completed. If the drying operation has not been completed yet, the microcomputer 90 proceeds to step S16, to continuously determine the clogging degree of the air passage. If the drying operation has been completed, the microcomputer 90 proceeds to step S19.

At step S19, the microcomputer 90 displays the final clogging degree or clogging state of the lint filter 42 through the display unit 9*b*. The display through the display unit 9*b* is continued until the supply of the commercial power to the dryer 1 is cut off. Accordingly, the user can continuously recognize the clogging degree of the lint filter 42. Thus, the user is induced to perform a desired task such as a cleaning operation for the lint filter 42, in accordance with the recognized clogging degree.

Since the user may clean the lint filter 42 before the supply of power to the dryer 1, step S13 and S124 may be dispensed with, and only the clogging degree determination and display at steps S16 and S17 may be executed.

FIG. 10B is a flow chart illustrating another embodiment of the display method for the dryer according to the present invention.

The embodiment of FIG. 10B corresponds to the case to which the display unit of FIG. 9B is applied.

In accordance with this embodiment, the microcomputer 90 determines whether or not commercial power is applied, at step S11. When commercial power is applied, the microcomputer 90 proceeds to step S12.

At step S12, the microcomputer 90 controls the display unit 9*b* such that the level indicators L1 to L4 are sequentially turned on, and then sequentially turned off, to enable the user to recognize a normal operation of the display unit 9*b*. The sequential turning-on of the level indicators L1 to L4 is carried out in such a manner that the level indicators L1 to L4 turn on one by one at intervals of a predetermined time. The sequential turning-off of the level indicators L1 to L4 is carried out in such a manner that, once all the level indicators L1 to L4 turn on, they turn off one by one at intervals of a predetermined time. The sequential turning-off of the level indicators L1 to L4 may be carried out, starting from the level indicator L1 and terminating at the level indicator L4. The microcomputer 90 may repeat the sequential turning-on/off operations several times.

At step S13, the microcomputer 90 determines whether or not there is a stored air passage clogging degree. If there is a stored air passage clogging degree, the microcomputer 90 proceeds to step S14. If not, the microcomputer 90 proceeds to step S15.

At step S14, the microcomputer 90 displays the stored air passage clogging degree through the display unit 9*b*. In this case, the display unit 9*b* turns on, from among the level indicators L1 to L4 or L1' to L4', the level indicators, which have critical clogging values not higher than the stored air passage clogging degree, to display the stored air passage clogging degree. The stored clogging degree is displayed following step S12. That is, the display of the stored clogging degree is carried out under the condition in which the user has been visually induced to observe the display unit 9*a*, by step S12. Thus, the user can more surely recognize the displayed clogging degree.

At step S15, the microcomputer 90 determines whether or not a drying operation begins in accordance with a drying operation start command input from the user through the input unit 9*a* or in accordance with a predetermined algorithm. When the drying operation begins, the microcomputer 90 proceeds to step S16.

At step S16, the microcomputer 90 determines ON/OFF states of the temperature control members in accordance with a detect signal from the detecting circuit 80, and calculates an ON/OFF duty ratio, based on the determined ON/OFF states. Based on the calculated ON/OFF duty ratio, the microcomputer 90 determines the clogging degree, clogging progress, or clogging state of the air passage.

If the determined clogging degree is higher than the currently-displayed clogging degree, the microcomputer 90 displays, at step S17, the determined clogging degree through the display unit 9*b*. If there is no clogging degree currently displayed, in this case, the microcomputer 90 displays the determined clogging degree through the display unit 9*b*.

At step S18, the microcomputer 90 determines whether or not the drying operation has been completed. If the drying operation has not been completed yet, the microcomputer 90 proceeds to step S16, to continuously determine the clogging degree of the air passage. If the drying operation has been completed, the microcomputer 90 proceeds to step S19.

At step S19, the microcomputer 90 displays the final clogging degree or clogging state of the air passage through the display unit 9*b*, and then stores the final clogging degree. The display through the display unit 9*b* is continued until the supply of the commercial power to the dryer 1 is cut off. Accordingly, the user can recognize the clogging degree of the air passage for a further prolonged period of time. Thus, the user is induced to perform a desired task such as a cleaning operation for the lint filter 42, in accordance with the recognized clogging degree.

Since the user may clean the air passage before using the dryer, step S13 and S124 may be dispensed with.

FIGS. 11A to 11D illustrate examples of sequential turning-on/off operations of the display device. These examples are associated with the sequential turning-on/off operations executed at step S12 in FIG. 10B.

FIG. 9B corresponds to a power-applied state. When step S12 is executed, the display unit 9*b* operates such that the level indicator L1 turns on, whereas the level indicators L2 to L4 are in an OFF state, as shown in FIG. 11A.

After a predetermined time elapses, the display unit 9*b* operates such that the level indicators L1 and L2 are in an ON state, whereas the level indicators L3 and L4 are in an OFF state, as shown in FIG. 11B.

After the predetermined time elapses again, the display unit 9*b* operates such that the level indicators L1 to L3 are in an ON state, whereas the level indicator L4 is in an OFF state, as shown in FIG. 11C.

After the predetermined time elapses again, the display unit 9*b* operates such that all the level indicators L1 to L4 are in an ON state, as shown in FIG. 11D.

After the predetermined time elapses again, the display unit 9*b* sequentially performs display operations respectively identical to those of FIG. 11C, FIG. 11B, FIG. 11A, and FIG. 9B at intervals of the predetermined time. Here, the display operation of FIG. 9B is an initial display operation.

After all the level indicators L1 to L4 turn on, as shown in FIG. 11D, they may flicker several times, and then turn off in a sequential manner.

FIG. 12 illustrates an example of the operation of the display device to display a clogging degree. As shown in FIG. 12, the microcomputer 90 displays the clogging degree of the air passage through the corresponding level indicators at step S14 or S17, to enable the user to easily recognize the clogging degree.

Although the present invention has been described in conjunction with the above-described embodiments and the accompanying drawings, it is not limited to such embodiments and drawings.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

As apparent from the above description, the present invention provides an effect capable of display the clogging degree of an air passage used in a drying operation in the dryer.

The present invention also provides an effect capable of displaying a normal operation state of a display unit when power is applied to the dryer, thereby enabling the user to identify whether or not the display unit operates normally.

The present invention also provides an effect capable of visually inducing the user to recognize a clogging degree of an air passage used in a drying operation of the dryer, thereby increasing effects of recognizing the clogging degree of the air passage.

What is claimed is:

1. A display device of a dryer, comprising:

a display;

at least one level indicator provided with the display, wherein the at least one level indicator indicates a clogging level of an air passage of the dryer;

at least one temperature control device that detects a temperature of air in the air passage; and a controller configured to control the display when power is supplied, wherein the controller is configured to control the at least one level indicator to flicker for a predetermined time to indicate that the display is in a normal operational state, and wherein the controller is further configured to turn the at least one temperature control device on and off based on the detected temperature of air in the air passage, to calculate corresponding on/off duty ratios and determine a corresponding clogging degree of the air passage based on the calculated on/off duty ratios, and to display the determined clogging degree of the air passage on the display using the at least one level indicator.

2. The display device according to claim 1, wherein the at least one level indicator comprises a plurality of level indicators, and wherein the controller is configured to control the display such that the plurality of level indicators are sequentially turned on, and then sequentially turned off, and at least one of the plurality of level indicators then displays the clogging degree of the air passage.

3. The display device according to claim 2, wherein the controller is configured to turn the plurality of level indicators on or off at intervals of a predetermined time.

4. The display device according to claim 2, wherein the plurality of level indicators are aligned and uniformly spaced apart from one another.

5. The display device according to claim 1, wherein the clogging degree of the air passage comprises at least one of a clogging degree of an exhaust duct or a clogging degree of a lint filter.

6. The display device according to claim 1, wherein the controller is configured to control the display to display the clogging degree of the air passage until the supply of the power is cut off.

7. A method for displaying a clogging degree in a dryer, comprising:

displaying a flicker of at least one indicator on a display for a predetermined time when power is supplied;

calculating on/off duty ratios of a temperature control device that is turned on or turned off based on a temperature of air in the air passage;

determining the clogging degree based on the calculated on/off duty ratios of the temperature control device; and displaying the determined clogging degree of the air passage on the display using the at least one indicator.

8. The method according to claim 7, wherein displaying the determined clogging degree of the air passage comprises displaying the determined clogging degree when the determined clogging degree of the air passage is greater than a critical clogging value.

9. The method according to claim 7, wherein displaying a flicker of at least one indicator on a display for a predetermined time when power is applied comprises sequentially turning on a plurality of level indicators and then sequentially turning off the plurality of level indicators.

10. The method according to claim 9, wherein sequentially turning on and then sequentially turning off the plurality of level indicators comprises sequentially turning on and then sequentially turning off the plurality of level indicators at intervals of a predetermined time.

11. The method according to claim 7, further comprising displaying the determined clogging degree until the supply of power is cut off.

12. The method according to claim 7, wherein displaying the determined clogging degree comprises displaying the determined clogging degree during an execution of a drying operation.

13. The method according to claim 7, wherein the clogging degree of the air passage comprises at least one of a clogging degree of an exhaust duct or a clogging degree of a lint filter.

* * * * *